US007148766B2

(12) United States Patent
Tong et al.

(10) Patent No.: US 7,148,766 B2
(45) Date of Patent: Dec. 12, 2006

(54) TRANSITION BETWEEN A MICROSTRIP CIRCUIT AND A WAVEGUIDE INCLUDING A BAND STOP FILTER AND OUTSIDE TRANSMISSION RECEPTION UNIT INCORPORATING THE TRANSITION

(75) Inventors: Dominique Lo Hine Tong, Rennes (FR); Jean-François Pintos, Bourgbarre (FR); Philippe Minard, Saint Medard ser Ille (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/767,886

(22) Filed: Jan. 29, 2004

(65) Prior Publication Data

US 2004/0183621 A1 Sep. 23, 2004

(30) Foreign Application Priority Data

Jan. 31, 2003 (FR) ..... 03 01429

(51) Int. Cl.
*H01P 5/107* (2006.01)

(52) U.S. Cl. ..... 333/26; 333/230; 333/208

(58) Field of Classification Search ..... 333/26, 333/208, 230

See application file for complete search history.

(56) References Cited

U.S. PATENT DOCUMENTS 4,547,901 A * 10/1985 Shibata et al. ..... 455/300
5,235,300 A * 8/1993 Chan et al. ..... 333/247
5,414,394 A * 5/1995 Gamand et al. ..... 333/26
5,808,519 A * 9/1998 Gotoh et al. ..... 333/26

FOREIGN PATENT DOCUMENTS

| | | | | |
|---|---|---|---|---|
| EP | 0715368 | | 6/1996 | |
| JP | 51702 | * | 3/1988 | ..... 333/238 |
| WO | WO 02 071533 | | 9/2002 | |

OTHER PUBLICATIONS

Patent Abstracts of Japan, vol. 2000, No. 02, Feb. 2000—JP 11330810 A Nov. 1999.
Patent Abstracts of Japan, vol. 2000, No. 12, Jan. 2001—JP 2000 244211, Sep. 2000.
Patent Abstracts of Japan, vol. 2002, No. 08, Aug. 2002,—JP 2002 118404, Apr. 2002.
French Search Report of Oct. 7, 2003.

* cited by examiner

*Primary Examiner*—Benny Lee
(74) *Attorney, Agent, or Firm*—Joseph J. Laks; Robert D. Shedd; Brian J. Cromarty

(57) ABSTRACT

The invention proposes a transition between a microstrip technology circuit and a waveguide, the waveguide being furnished with a probe linked electrically to the microstrip circuit. The transition comprises at least one first resonant cavity coupled by a first hole placed level with the said plane. The transition furnished with the cavity behaves as a bandstop filter. The transition is placed in an outside unit of a transmission system comprising a transmit circuit embodied in microstrip technology and an antenna of waveguide type. A transmit circuit comprises at least one local oscillator and the resonant cavity is tuned to the frequency of the local oscillator.

7 Claims, 3 Drawing Sheets

TRANSITION BETWEEN A MICROSTRIP CIRCUIT AND A WAVEGUIDE INCLUDING A BAND STOP FILTER AND OUTSIDE TRANSMISSION RECEPTION UNIT INCORPORATING THE TRANSITION

This application claims the benefit under 35 U.S.C. § 119(a) of French patent application No. 0301429 filed Jan. 31, 2003.

BACKGROUND OF THE INVENTION

1. Field of the Invention

The invention pertains to a transition between a microstrip circuit and a waveguide. More particularly, the transition which is the subject of the invention corresponds to a transition for a transmit circuit of an outside transmit/receive unit. The invention pertains also to the outside transmit/receive unit.

2. Related Art

Bidirectional-satellite transmissions are being called on to develop, within the mass marker sector, low-cost solutions are currently being sought so as to be able to disseminate them on a large scale. For a bidirectional system, it is preferable to use one antenna rather than two antennas.

A known problem with respect to the transmission standards defined by the public organizations for allocating frequency is that they require that transmitted signals should come within a specific transmission spectrum template. Another known problem relates to the coupling between transmission and reception. Specifically, the same antenna being used for transmission and for reception, the high-power transmitted signals will disturb the low-power received signals. Although the transmit and receive bands are seperated, it is necessary to have good filtering on reception in order to reduce the saturation of the low noise amplifier.

The local oscillator used for transmission may be at a frequency lying very near the transmission band and precludes the possibility of an effective bandpass filter for so close a frequency. Furthermore, the signal corresponding to the local oscillator is as amplified as the transmitted signal. It is known to use an additional bandstop filter to attenuate the frequency line corresponding to the local oscillator.

FIG. 1 represents an exemplary outside unit I according to the state of the art. At the output of the mixer 3, a bandpass filter 4 selects the transmission band and attenuates the signal corresponding to the frequency of the local oscillator 2. However, such filteing is not sufficient and requires the addition of a bandsrop filter 5 to attenuate the signal corresponding to the frequency of the local oscillator 2 by at least 50 dB. A power amplifier 6 then amplifies the signal to be transmitted before the signal is transformed into an electromagnetic wave by a transition 7 between a microstrip technology circuit and a waveguide 8 linked to a horn 9. The use of the bandstop filter 5 has the effect of eliminating the component corresponding to the local oscillator 2. Thus, the frequency of the local oscillator 2 is no longer a nuisance in respect of the transmission. Moreover, the possible echo of the signal corresponding to the frequency of the local oscillator 2 being greatly attenuated, therefore minimizing local oscillator signal contribution to the saturation of the low noise amplifier of the reception circuit.

On the other hand, the embodying of a microstrip technology filter requires a lengthening of the microstrip lines and the addition of amplifiers 11 and 12. Microstrip technology does not permit a good quality factor to be obtained in respect of the embodying of the bandstop filter 5. It is relatively difficult to have 50 dB of attenuation, this requiring the constraints on the bandpass filter 4 to be increased.

SUMMARY OF THE INVENTION

The invention proposes to remedy the problem related to the bandstop filter by introducing one or more cavities at the transition between the microstrip circuit and the waveguide.

The invention is a transition between a microstrip technology circuit and a waveguide, the waveguide being furnished with a probe linked electrically to the microstrip circuit, the probe being placed in a plane perpendicular to the direction of propagation of the wave, the plane being situated a distance which is an odd multiple of a quarter of the guided wavelength away from a bottom of the guide. The transition comprises at least one first resonant cavity coupled by a first slot located at the level of the probe.

Preferably, the first cavity is dimensioned to resonate at a determined frequency so that the transition behaves as a bandstop filter for this determined frequency. The guide is of rectangular section and the hole is a slot.

According to a variant, the waveguide comprises a second cavity coupled to the waveguide by a second hole, the second hole being diametrically opposite the first hole. The first and the second cavities are dimensioned to resonate at two neighboring frequencies so that the transition behaves as a bandstop filter, the band being of a width corresponding to the manufacturing tolerance of the cavities.

The invention is also an outside unit of a transmission/reception system comprising a transmit circuit embodied in microstrip technology and a transmission/reception antenna of waveguide type, the transmit circuit comprising at least one local oscillator. The unit comprises a transition as defined above between the transmit circuit and the antenna.

Preferably, the resonant frequency of the cavity corresponds to the frequency of oscillation of the local oscillator, to within a manufacturing tolerance. The resonant frequencies of the two cavities are placed on either side of the frequency of the local oscillator.

BRIEF DESCRIPTION OF THE DRAWINGS

The invention will be better understood and other features and advantages will become apparent on reading the description which follows, the description making reference to the appended drawings in which.

DETAILED DESCRIPTION OF PREFERRED EMBODIMENTS

Figure 1:
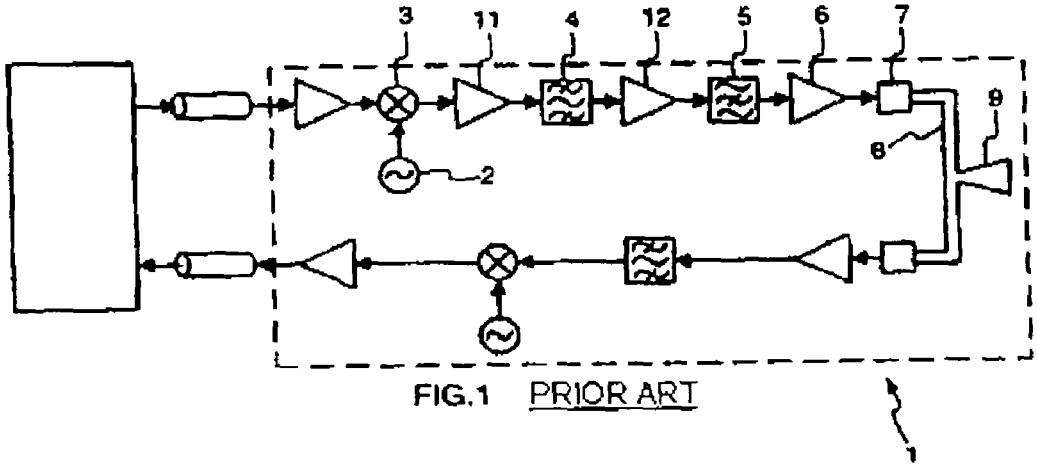
FIG.1 PRIOR ART
FIG. 1 represents an outside unit according to the state of the art.

FIG. 1 having already been described, it will not be detailed further.

Figure 2:
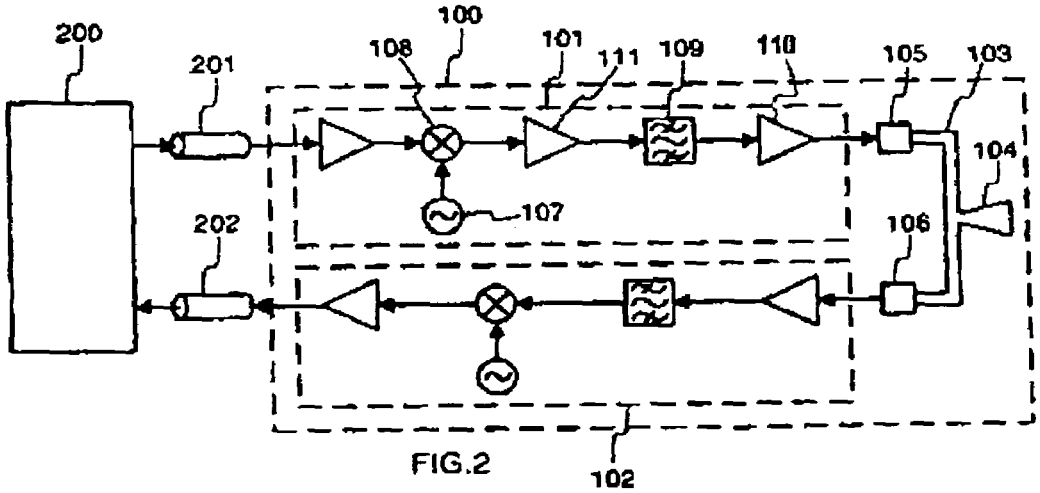
FIG. 2 represents an outside unit according to the invention.

FIG. 2 diagrammatically represents a bidirectional communication system according to the invention. The communication system is for example a satellite communication system that comprises an outside unit 100 linked to an inside unit 200 by way of two coaxial cables 201 and 202.

The outside unit 100 comprises a transmit circuit 101 and a receive circuit 102 embodied in microstrip technology. A waveguide 103 embodies the junction between a horn 104 and, on the one hand, the transmit circuit 101 by way of a transition 105, and on the other hand, the receive circuit 102 by way of a transition 106. Focusing means (not represented), such as for example a parabolic reflector, face the horn so as to direct the waves in a given direction. The transition 105 linking the transmit circuit 101 and the waveguide 103 includes a bandstop filter and will be detailed in greater detail with the aid of FIGS. 3 to 6.

The transmit circuit comprises a local oscillator 107 coupled to a mixer 108 for performing a transposition of the signals situated in an intermediate transmit frequency band, lying for example between 950 and 1450 MHz, into the transmit frequency band, lying for example between 29.5 and 30 GHz. The frequency of the local oscillator 107 is located at a frequency of 28.55 GHz i.e. very close to the frequency band transmitted. A bandpass filter 109 selects the transmit band and rejects the image band situated between 27.1 and 27.6 GHz, the dimensioning of this bandpass filter 109 being done without taking account of the presence of the local oscillator 107. A power amplifier 110, placed between the bandpass filter 109 and the transition 105, amplifies the signals to be transmitted. An additional amplifier 111 is placed between the mixer 108 and the filter 109.

Figure 3:
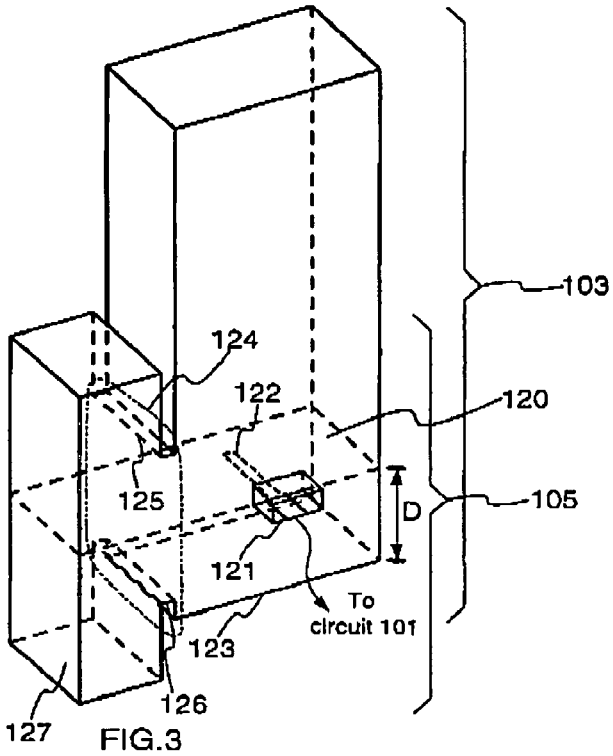
FIGS. 3 and 4 represent a first embodiment of a transition according to the invention.
Figure 4:
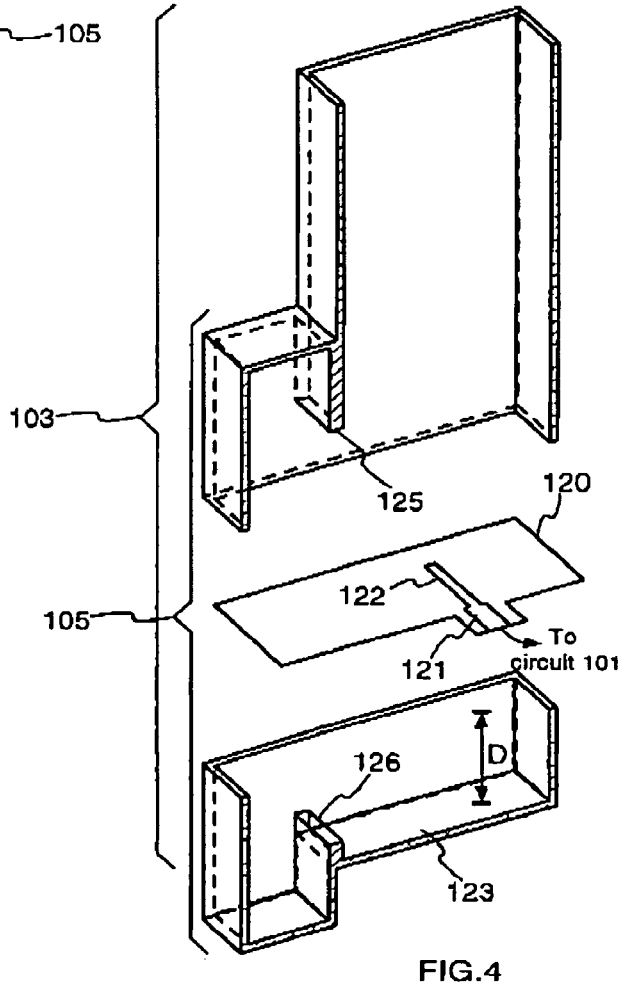

As indicated previously, the transition 105 includes a bandstop filter for rejecting the frequency of the local oscillator 107. FIGS. 3 and 4 show a first embodiment of a transition 105 according to the invention. FIG. 3 represents the active contours of the transition and FIG. 4 represents an exploded cross-sectional view of the transition.

The transition 105 forms the junction between the waveguide 103 and the transmit circuit (to circuit 101) (FIG. 2) which is not represented in the figures but is supported by the substrate 120. A microstrip line 121 carried by the substrate 120 and linked to the transmit circuit 101 is transformed into a probe 122 inside the guide. The substrate 120 is placed a distance D from a bottom 123 of the waveguide 102, the distance D being an odd multiple of a quarter of the wavelength guided by the waveguide 103.

At the level of the transition 105, a slot 124 delimited by the two ledges 125 and 126 is placed on one side at the waveguide 103 at the level of the substrate 120. This slot 124 emerges into a cavity 127 (FIG. 3). The cavity 127 is dimensioned so that it has a resonant frequency that is substantially equal to the frequency of the local oscillator 107 (FIG. 2). The presence of the cavity 127 acts as a frequency trap and behaves as a bandstop filter of very good quality.

As regards production, the transition is produced in two parts, as shown in FIG. 4. Each part can consist of two half-shells produced for example by moulding and/or machining. The use of a cavity 127 placed at the level of the transition 105 makes it possible not to increase the size of the waveguide as would a conventional waveguide filter.

A production difficulty stems from the tolerances on the dimensions of the cavity 127. This cavity must be machined accurately enough for the resonant frequency to be very close (ideally equal) to the frequency of the local oscillator. Now, such machining accuracy may seem expensive for mass production.

Figure 5:
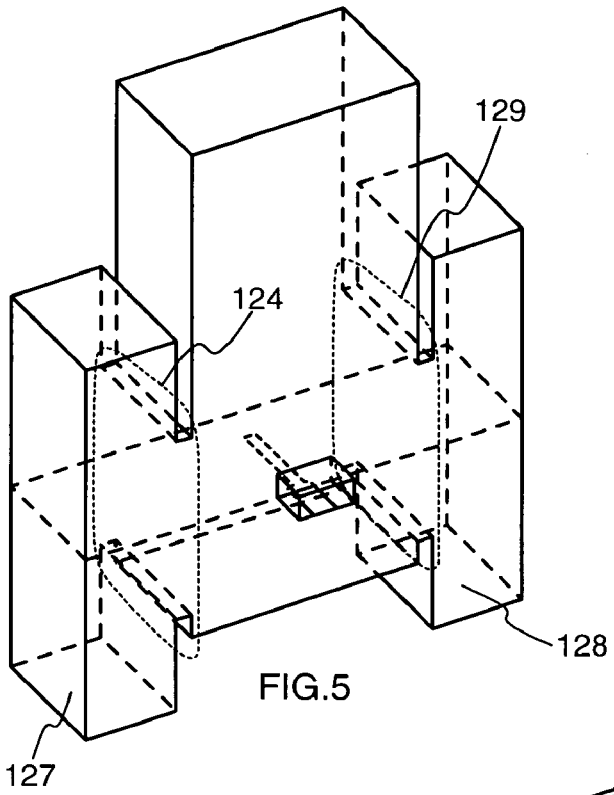
FIGS. 5 and 6 represent a second embodiment of a transition according to the invention.
Figure 6:
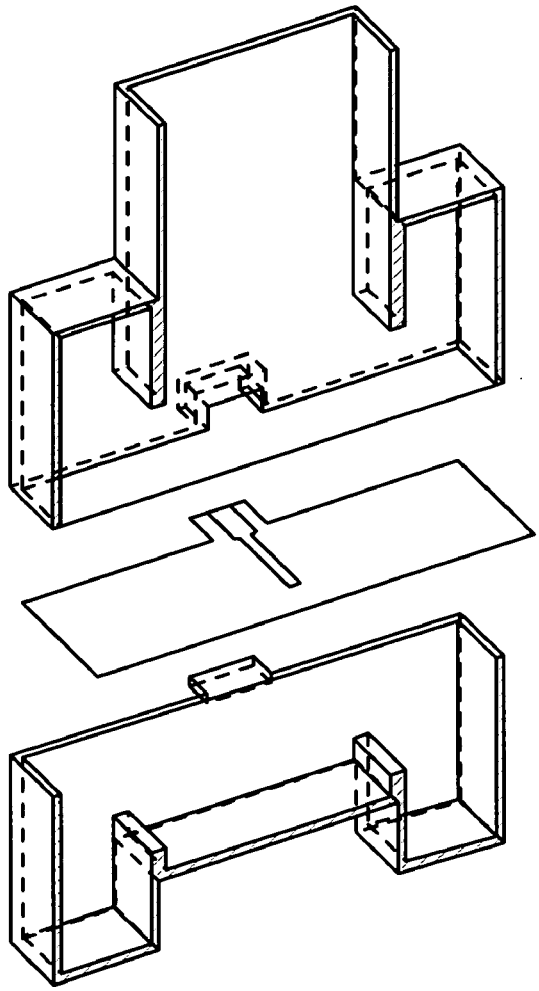

According to a variant embodiment represented with the aid of FIGS. 5 and 6, a second cavity 128 coupled to the guide 103 by a second slot 129 is added at the level of the transition 105. The second slot 129 is centred with respect to the substrate 120 and placed on a side of the waveguide 103 which is for example opposite from the first slot 124.

The first and second cavities 127 and 128 are dimensioned so that their resonant frequencies are situated on either side of the frequency of the local oscillator 107 and spaced apart by a frequency band slightly greater than the variation in frequency that results from the manufacturing tolerance of the said cavities 127 and 128. Thus, with two cavities, a bandstop filter is produced for the frequency of the local oscillator 107 while being able to use less expensive manufacturing tolerances.

Other variants of the invention are possible. The preferred exemplary embodiments show a waveguide of rectangular section but it is entirely possible to have a waveguide of circular, square or elliptic cross section. Also, the slots may be replaced by any type of coupling hole and the shape of the cavities is of little importance provided that they have a resonant frequency tuned to the local oscillator as indicated with both embodiments.

The invention claimed is:

1. Outside unit of a transmission/reception system comprising a transmit circuit embodied in microstrip technology and a transmission/reception waveguide antenna, the transmit circuit comprising a local oscillator, wherein said outside unit comprises a transition, between the transmit circuit and the antenna, said transition comprising:

a probe inside the waveguide, said probe being linked electrically to the transmit circuit, said probe being placed on a substrate in a plane perpendicular to the direction of the propagation of the wave inside the waveguide, said substrate being located at a distance which is an odd multiple of a quarter of the guided wavelength away from a bottom of the waveguide, and a first resonant cavity coupled by a first hole placed at the level of the substrate, wherein the waveguide comprises a second cavity coupled to the waveguide by a second hole, the second hole being diametrically opposite the first hole.

2. Outside unit according to claim 1, wherein the first and second cavities are respectively dimensioned to resonate at two neighboring frequencies so that the transition behaves as a bandstop filter, the band being of a width corresponding to a variation in frequency resulting from a manufacturing tolerance of said first cavity and a manufacturing tolerance of the second cavity.

3. Outside unit according to claim 2 wherein the resonant frequencies of the first and second cavities are placed on either side of the frequency of the local oscillator.

4. Transition between a microstrip technology circuit and a waveguide, the waveguide being furnished with a probe linked electrically to the microstrip circuit, the said probe being placed on a substrate in a plane perpendicular to the direction of propagation of the wave in the waveguide, the substrate being situated a distance which is an odd multiple of a quarter of the guided wavelength away from a bottom of the waveguide, wherein the transition comprises at least one first resonant cavity coupled to the waveguide by a first hole placed at the level of said substrate, wherein the waveguide comprises a second cavity coupled to the waveguide by a second hole, the second hole being diametrically opposite the first hole.

5. Transition according to claim 4, wherein the first and second cavities are respectively dimensioned to resonate at two neighboring frequencies so that the transition behaves as a bandstop filter, the stopped band being of a width corresponding to a variation in frequency resulting from a manufacturing tolerance of said cavities.

6. Outside unit of a transmission/reception system comprising a transmit circuit embodied in microstrip technology and a transmission/reception waveguide antenna, the transmit circuit comprising a local oscillator, wherein said outside unit comprises a transition, between the transmit circuit and the antenna, said transition comprising:

a probe inside the waveguide, said probe being linked electrically to the transmit circuit, said probe being placed on a substrate in a plane perpendicular to the direction of the propagation of the wave inside the waveguide, said substrate being located at a distance which is an odd multiple of a quarter of the guided wavelength away from a bottom of the waveguide, and a first resonant cavity coupled by a first hole placed at the level of the substrate, wherein the first resonant cavity is dimensioned to resonate at a determined frequency so that the transition behaves as a bandstop filter for the determined frequency.

7. Transition between a microstrip technology circuit and a waveguide, the waveguide being furnished with a probe linked electrically to the microstrip circuit, the said probe being placed on a substrate in a plane perpendicular to the direction of propagation of the wave in the waveguide, the substrate being situated a distance which is an odd multiple of a quarter of the guided wavelength away from a bottom of the waveguide, wherein the transition comprises at least one first resonant cavity coupled to the waveguide by a first hole placed at the level of said substrate, wherein the first cavity is dimensioned to resonate at a determined frequency so that the transition behaves as a bandstop filter for said determined frequency.

* * * * *